US011346354B2

(12) United States Patent
Tang et al.

(10) Patent No.: US 11,346,354 B2
(45) Date of Patent: May 31, 2022

(54) DOWNROD ASSEMBLY AND CEILING FAN

(71) Applicants: GD MIDEA ENVIRONMENT APPLIANCES MFG CO., LTD., Zhongshan (CN); MIDEA GROUP CO., LTD., Foshan (CN)

(72) Inventors: Xinmin Tang, Zhongshan (CN); Shuisheng Lei, Zhongshan (CN); Yaoguang Liang, Zhongshan (CN)

(73) Assignees: GD MIDEA ENVIRONMENT APPLIANCES MFG., CO. LTD., Zhongshan (CN); MIDEA GROUP CO., LTD., Foshan (CN)

( * ) Notice: Subject to any disclaimer, the term of this patent is extended or adjusted under 35 U.S.C. 154(b) by 1132 days.

(21) Appl. No.: 15/851,471

(22) Filed: Dec. 21, 2017

(65) Prior Publication Data

US 2018/0112680 A1 Apr. 26, 2018

Related U.S. Application Data

(63) Continuation of application No. PCT/CN2016/079689, filed on Apr. 19, 2016.

(51) Int. Cl.

| | |
|---|---|
| ***F04D 25/08*** | (2006.01) |
| ***F04D 29/60*** | (2006.01) |
| ***F04D 29/64*** | (2006.01) |
| *F04D 25/06* | (2006.01) |

(52) U.S. Cl.

CPC ..... *F04D 25/088* (2013.01); *F04D 29/601* (2013.01); *F04D 29/644* (2013.01); *F04D 25/0693* (2013.01)

(58) Field of Classification Search

None

See application file for complete search history.

(56) References Cited

U.S. PATENT DOCUMENTS

| | | | |
|---|---|---|---|
| 6,913,443 | B2 | 7/2005 | Chen |
| 7,621,498 | B2 | 11/2009 | Tang |

(Continued)

FOREIGN PATENT DOCUMENTS

| | | | |
|---|---|---|---|
| CN | 1080697 | A | 1/1994 |
| CN | 201202949 | Y | 3/2009 |

(Continued)

OTHER PUBLICATIONS

GD Midea Environment Appliances Mfg. Co., Ltd./ Midea Group Co, Ltd., Examination Report No. 2, AU2016387081, dated Jun. 27, 2019, 3 pgs.

(Continued)

*Primary Examiner* — Juan G Flores

(74) *Attorney, Agent, or Firm* — Morgan, Lewis & Bockius LLP

(57) ABSTRACT

A downrod assembly includes: an electric motor, an adapter subassembly and a downrod. The adapter subassembly is connected to an electric motor shaft of the electric motor; and the downrod is connected to the adapter subassembly and is capable of rotating with respect to the electric motor by means of the adapter subassembly. The downrod is able to be folded by rotating with respect to the electric motor during transportation, thereby reducing the overall packaging volume of a ceiling fan.

18 Claims, 6 Drawing Sheets

(56) References Cited

U.S. PATENT DOCUMENTS

| | | | | |
|---|---|---|---|---|
| 8,152,453 | B2 * | 4/2012 | Oleson | F16M 13/027 415/126 |
| 10,458,418 | B2 * | 10/2019 | Yamamoto | F04D 29/646 |
| 2008/0298968 | A1 | 12/2008 | Frampton et al. | |
| 2009/0072108 | A1 * | 3/2009 | Oleson | F04D 25/088 248/282.1 |
| 2010/0314520 | A1 | 12/2010 | Collmar | |
| 2011/0002783 | A1 | 1/2011 | Yamamoto et al. | |
| 2011/0052411 | A1 * | 3/2011 | Yamamoto | F04D 25/08 416/244 R |
| 2017/0101998 | A1 * | 4/2017 | Yamamoto | F04D 25/088 |

FOREIGN PATENT DOCUMENTS

| | | | |
|---|---|---|---|
| CN | 102434484 | A | 5/2012 |
| CN | 203272206 | U | 11/2013 |
| CN | 203867995 | U | 10/2014 |
| CN | 104912819 | A | 9/2015 |
| CN | 204783859 | U | 11/2015 |
| CN | 105782128 | A | 7/2016 |
| CN | 205533443 | A | 8/2016 |
| JP | H04-034496 | U | 3/1992 |
| JP | 2015-190422 | A | 11/2015 |

OTHER PUBLICATIONS

GD Midea Environment Appliances Mfg. Co., Ltd./ Midea Group Co, Ltd., Further Examination Report, NZ733938, dated Apr. 11, 2019, 5 pgs.

GD Midea Environment Appliances Mfg. Co., Ltd./ Midea Group Co, Ltd., Further Examination Report Postponed Acceptance, NZ733938, dated Jul. 22, 2019, 1 pg.

GD Midea Environment Appliances Mfg. Co., Ltd./ Midea Group Co, Ltd, Invitation to Respond to Written Opinion, SG11201706139S, dated Apr. 30, 2018, 8 pgs.

GD Midea Environment Appliances MFG. Co., Ltd, International Search Report and Written Opinion, PCT/CN2016/079689, dated Jan. 18, 2017

GD Midea Environment Appliances MFG Co., Ltd., International Preliminary Report on Patentability, PCT/CN2016/079689, dated Oct. 23, 2018, 4 pgs.

Midea Group Co., Ltd., GD Midea Environment Appliances MFG. Co., Ltd., Substantive Examination Adverse Report (Section 30 (1), Malaysia Application No. PI 2017703718, dated Nov. 18, 2020, 4 pgs.

* cited by examiner

DOWNROD ASSEMBLY AND CEILING FAN

PRIORITY CLAIM AND RELATED APPLICATION

This application is a continuation application of PCT/CN2016/079689, entitled "DOWNROD ASSEMBLY AND CEILING FAN" filed on Apr. 19, 2016, which is incorporated herein by reference in its entirety.

FIELD

The present disclosure relates to a field of household appliances, and more particularly to a downrod assembly and a ceiling fan has the same.

BACKGROUND

In the related art, there are generally two ways of packaging and transporting a ceiling fan. The first way is to package and transport the ceiling fan after it is assembled, but the assembled ceiling fan has a large volume, which is not convenient for packaging and transportation, and a lot of space between the packaged ceiling fan and a packaging material is not fully utilized, resulting in a waste of resources. The second way is to detach various parts of the ceiling fan from each other and package the parts, but some of the parts are easily lost during handling and transportation due to a small volume, causing the ceiling fan unable to be assembled.

SUMMARY

In order to address at least one of the above problems, an objective of the present disclosure is to provide a downrod assembly simple in structure and convenient to package.

Another objective of the present disclosure is to provide a ceiling fan having the above downrod assembly.

Accordingly, a downrod assembly is provided by embodiments of a first aspect of the present disclosure. The downrod assembly is connected to an electric motor, and includes an adapter subassembly connected to an electric motor shaft of the electric motor; and a downrod connected to the adapter subassembly and capable of rotating with respect to the electric motor by means of the adapter subassembly.

For the ceiling fan provided by the present disclosure, the downrod is able to rotate with respect to the electric motor, and the downrod is folded during transportation and handling to reduce the volume of the ceiling fan, thereby reducing the packaging volume. On the one hand, more ceiling fans may be transported without changing a space for transportation in a transport device, thereby improving transport efficiency, and moreover, manual handling may be convenient, thereby improving handling efficiency.

Specifically, the ceiling fan in the related art is packaged and transported either after being assembled, or after being detached. However, the assembled ceiling fan has a relatively large volume, which is not convenient for packaging and transportation; some of individual parts of the detached ceiling fan are easily lost during handling and transportation due to a small volume. For the ceiling fan provided by the present disclosure, on the one hand, it is possible to avoid loss of small parts caused by detaching and packaging individual parts of the ceiling fan. On the other hand, it is possible to avoid inconvenient handling and low transport efficiency of the ceiling fan caused by a large volume of the downrod and the electric motor in the assembled ceiling fan.

Specifically, the volume of the ceiling fan is relatively small after the downrod rotates with respect to the electric motor, such that more ceiling fans can be transported without changing the space for transportation in a transport device, thereby improving the transport efficiency, and moreover, manual handling may be convenient, thereby improving handling efficiency.

Additionally, the ceiling fan provided by the above embodiments of the present disclosure may have the following additional technical features.

In the above technical solution, the adapter subassembly includes: a base seat including a base plate and two lateral plates, in which the base plate and the two lateral plates define a mounting groove, and the base plate is fixedly connected to the electric motor shaft; and an adapter rotatably connected to the two lateral plates, and connected to the downrod.

In this technical solution, in a process of producing and assembling a product, an external force is exerted on the downrod, and the downrod drives the adapter to rotate with respect to the base seat to a horizontal state. After the downrod is rotated with respect to the electric motor, the volume of the ceiling fan is reduced, such that more ceiling fans can be transported without changing the space for transportation in the transport device, thereby improving the transport efficiency, and moreover, manual handling may be convenient, thereby improving the handling efficiency. In addition, the base seat and the adapter are simple in structure, easy to assemble and reliable in connection, thereby improving assembly efficiency of the product on the one hand, and enhancing operational reliability of the product on the other hand.

In any one of the above technical solutions, the base seat is provided with a connecting column, the adapter is provided with a connecting hole, and a first fixing member passes through the connecting hole to be connected to the connecting column, such that the adapter is fixedly connected to the base seat.

In this technical solution, when a user needs to mount the ceiling fan, the downrod is rotated with respect to the base seat by means of the adapter until the downrod is perpendicular to the horizontal plane, that is, after the downrod is rotated with respect to the electric motor to be perpendicular to the horizontal plane, the adapter is fixedly connected to the base seat by means of the first fixing member, i.e., the downrod is fixed to the electric motor. Thus, it is possible to prevent the electric motor from shaking relative to the downrod during use of the ceiling fan, which otherwise will cause safety problems (e.g. cause the electric motor to fall off), thus enhancing the operational reliability of the product, thereby increasing market competitiveness of the product.

In any one of the above technical solutions, the first fixing member is configured as a first screw, the connecting column is provided with a threaded hole, and the first screw passes through the connecting hole and is screwed into the threaded hole.

In this technical solution, the connection by means of the screw has a simple structure and is reliable, which improves the assembly efficiency of the product and lowers production and manufacturing costs of the product on the one hand, and enhances the operational reliability of the product on the other hand, thereby increasing the market competitiveness of the product.

In any one of the above technical solutions, the base seat is provided with a positioning plate, the positioning plate is provided with a fastening screw, and the adapter is provided with a notch; in which the adapter is rotated to be engaged with the fastening screw through the notch, and then the fastening screw is tightened, such that the adapter is fixedly connected to the base seat.

In this technical solution, when the user needs to mount the ceiling fan, the downrod is rotated with respect to the base seat by means of the adapter until the downrod is perpendicular to the horizontal plane, that is, after the downrod is rotated with respect to the electric motor to be perpendicular to the horizontal plane, the adapter is engaged with the fastening screw through the notch, and then the fastening screw is tightened, such that the adapter is fixed to the base seat. i.e., the downrod is fixed to the electric motor. Thus, it is possible to prevent the electric motor from shaking relative to the downrod during use of the ceiling fan, which otherwise will cause safety problems (e.g. cause the electric motor to fall off), thus enhancing the operational reliability of the product, thereby increasing the market competitiveness of the product.

In any one of the above technical solutions, the adapter includes a first connecting portion and a second connecting portion connected to the first connecting portion, the adapter has an L shape as a whole, and the first connecting portion and the second connecting portion are connected by a circular arc transition.

In this technical solution, the arrangement of the circular arc transition enables the adapter to rotate more smoothly relative to the base seat, thus improving operational comfort of the product, thereby increasing the market competitiveness of the product.

In any one of the above technical solutions, the second connecting portion includes a casing with an open end, the connecting column is inserted into the casing, and the connecting hole is disposed in the casing.

In this technical solution, the connecting column is inserted into the casing to increase a connection area between the connecting column and the casing. When the ceiling fan needs to be mounted, the adapter is fixed to the base seat by means of the first fixing member, i.e., the downrod is fixed to the electric motor. Thus, it is possible to prevent the electric motor from shaking relative to the downrod during use of the ceiling fan, which otherwise will cause safety problems (e.g. cause the electric motor to fall off), thus enhancing the operational reliability of the product, thereby increasing the market competitiveness of the product.

In any one of the above technical solutions, the base seat is provided with a through hole, and a wall of the through hole extends downwards to form an annular connecting plate; the electric motor shaft passes through the through hole and is connected to the two lateral plates by means of a first connecting member; and the connecting plate is connected to the electric motor shaft by means of a second fixing member.

In this technical solution, the electric motor shaft is connected to the base seat by means of the first connecting member and the second fixing member, such that it is possible to increase connection strength between the electric motor shaft and the base seat, and prevent the electric motor from shaking relative to the base seat during use of the ceiling fan, which otherwise will cause safety problems (e.g. cause the electric motor to fall off), thus enhancing the operational reliability of the product, thereby increasing the market competitiveness of the product.

In any one of the above technical solutions, the first connecting member includes a first plug pin and a first split pin; a first end of the first plug pin passes through a first lateral plate, a first end of the adapter, the electric motor shaft, a second end of the adapter, and a second lateral plate sequentially, and extends out of the second lateral plate; the first split pin is connected to the first end of the first plug pin and is able to interfere with the second lateral plate.

In this technical solution, the connection by means of the plug pin and the split pin has a simple structure and is reliable, which improves the assembly efficiency of the product and lowers production and manufacturing costs of the product on the one hand, and enhances the operational reliability of the product on the other hand, thereby increasing the market competitiveness of the product.

In any one of the above technical solutions, the first connecting member includes a first bolt and a first nut; a first end of the first bolt passes through a first lateral plate, a first end of the adapter, the electric motor shaft, a second end of the adapter, and a second lateral plate sequentially, and extends out of the second lateral plate; the first nut is screwed with the first bolt tightly, such that the base seat is fixedly connected to the electric motor shaft.

In this technical solution, the connection through cooperation between the bolt and the nut has a simple structure and is reliable, which improves the assembly efficiency of the product and lowers production and manufacturing costs of the product on the one hand, and enhances the operational reliability of the product on the other hand, thereby increasing the market competitiveness of the product.

In any one of the above technical solutions, the second fixing member is configured as a second screw; the second screw penetrates from a first end of the connecting plate and passes through the electric motor shaft to be screwed into a second end of the connecting plate.

In this technical solution, the connection by means of the screw has a simple structure and is reliable, which improves the assembly efficiency of the product and lowers production and manufacturing costs of the product on the one hand, and enhances the operational reliability of the product on the other hand, thereby increasing the market competitiveness of the product.

In any one of the above technical solutions, the downrod is provided with a first wire-routing hole, the adapter is provided with a second wire-routing hole, the first wire-routing hole and the second wire-routing hole define a wire-routing passage, and a wire passes through the wire-routing passage to be connected to the electric motor.

In this technical solution, the arrangement of the wire-routing holes enables the downrod and the adapter to protect the wire on the one hand, thereby prolonging a service life of the wire, and can hide the wire to make the overall appearance of the ceiling fan more aesthetic on the other hand.

In any one of the above technical solutions, one of the adapter and the downrod is provided with an internal thread, the other one thereof is provided with an external thread, and the external thread is screwed into the internal thread, such that the adapter is fixedly connected to the downrod.

In this technical solution, the threaded connection has a simple structure and is reliable, which improves the assembly efficiency of the product and lowers production and manufacturing costs of the product on the one hand, and enhances the operational reliability of the product on the other hand, thereby increasing the market competitiveness of the product.

In any one of the above technical solutions, the adapter is connected to the downrod by means of a second connecting member.

In this technical solution, the adapter is connected to the downrod by means of threads and the second connecting member, such that it is possible to increase connection strength between the adapter and the downrod, and prevent the base seat from shaking relative to the downrod during use of the ceiling fan, which otherwise will cause safety problems (e.g. cause the electric motor to fall off), thus enhancing the operational reliability of the product, thereby increasing the market competitiveness of the product.

In any one of the above technical solutions, the second connecting member includes a second plug pin and a second split pin; a first end of the second plug pin penetrates from a first end of the adapter, passes through the downrod, and extends out of a second end of the adapter; the second split pin is connected to the first end of the second plug pin and is able to interfere with the adapter.

In this technical solution, the connection by means of the plug pin and the split pin has a simple structure and is reliable, which improves the assembly efficiency of the product and lowers production and manufacturing costs of the product on the one hand, and enhances the operational reliability of the product on the other hand, thereby increasing the market competitiveness of the product.

In any one of the above technical solutions, the second connecting member includes a second bolt and a second nut; a first end of the second bolt penetrates from a first end of the adapter, passes through the downrod, and extends out of a second end of the adapter; the second nut is screwed with the second bolt tightly, such that the downrod is fixedly connected to the adapter.

In this technical solution, the connection through cooperation between the bolt and the nut has a simple structure and is reliable, which improves the assembly efficiency of the product and lowers production and manufacturing costs of the product on the one hand, and enhances the operational reliability of the product on the other hand, thereby increasing the market competitiveness of the product.

The ceiling fan according to embodiments of a second aspect of the present disclosure includes the electric motor, and the downrod assembly according to any one of the above technical solutions. The downrod assembly is connected to the electric motor shaft of the electric motor.

The ceiling fan according to embodiments of the second aspect of the present disclosure has all of the above beneficial effects since it is provided with the downrod assembly according to embodiments of the first aspect of the present disclosure, which will not be elaborated herein.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and/or other aspects and advantages of the present disclosure will become apparent and more readily appreciated from the following descriptions of embodiments made with reference to the drawings, in which:

In which, a corresponding relationship between reference numerals and parts shown in FIG. 1-FIG. 9 is as follows:

Figure 1:
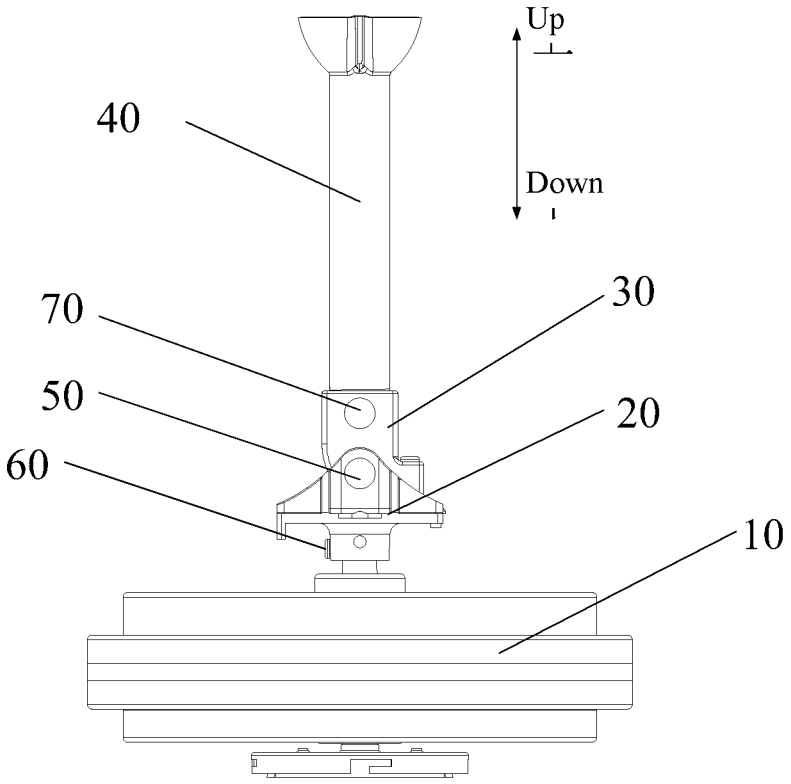
FIG. 1 is a schematic view of a ceiling fan in a first state of a first embodiment according to the present disclosure.

10 electric motor,
11 electric motor shaft,
20 base seat,
21 base plate,
22 lateral plate,
23 connecting column,
24 threaded hole,
25 connecting plate,
26 positioning plate,
30 adapter,
31 first connecting portion,
32 second connecting portion,
33 connecting hole,
34 second wire-routing hole,
35 internal thread,
36 notch,
40 downrod,
41 first wire-routing hole,
42 external thread,
50 first connecting member,
51 first plug pin,
52 first split pin,
53 first bolt,
54 first nut,
60 second screw,
70 second connecting member,
71 second plug pin,
72 second split pin,
73 second bolt,
74 second nut, and
80 fastening screw.

DETAILED DESCRIPTION

The present disclosure will be described in further detail with reference to the accompanying drawings and specific embodiments to provide a clearer understanding of the objectives, features and advantages of the present disclosure. It should be noted that embodiments and features in embodiments of the present disclosure may be combined with each other in the case of no conflict.

Many specific details set forth in the following description are intended to facilitate a thorough understanding of the present disclosure, but the present disclosure may be implemented otherwise than as described herein, and thus the protection scope of the present disclosure is not limited to the following specific embodiments.

A ceiling fan according to some embodiments of the present disclosure will be described with reference to FIGS. 1 to 9.

As shown in FIGS. 1 to 3, FIG. 8 and FIG. 9, a downrod assembly provided by embodiments of a first aspect of the present disclosure is connected to an electric motor of the ceiling fan, and includes an adapter subassembly and a downrod 40.

Specifically, the adapter subassembly is connected to an electric motor shaft 11 of the electric motor 10; the downrod 40 is connected to the adapter subassembly, and is able to rotate with respect to the electric motor 10 by means of the adapter subassembly.

For the ceiling fan provided by the present disclosure, the downrod 40 is able to rotate with respect to the electric motor 10, and the downrod 40 is folded during transportation and handling to reduce the volume of the ceiling fan. On the one hand, it is possible to avoid loss of small parts caused by detaching and packaging individual parts of the ceiling fan. On the other hand, it is possible to avoid inconvenient handling and low transport efficiency of the ceiling fan caused by a large volume of the downrod 40 and the electric motor 10 in the assembled ceiling fan. Specifically, the volume of the ceiling fan is relatively small after the downrod 40 rotates with respect to the electric motor 10, such that more ceiling fans can be transported without changing a space for transportation in a transport device, thereby improving the transport efficiency, and moreover, manual handling may be convenient, thereby improving handling efficiency.

In an embodiment of the present disclosure, as shown in FIGS. 1 to 9, the adapter subassembly includes a base seat 20 and an adapter 30.

Figure 4:
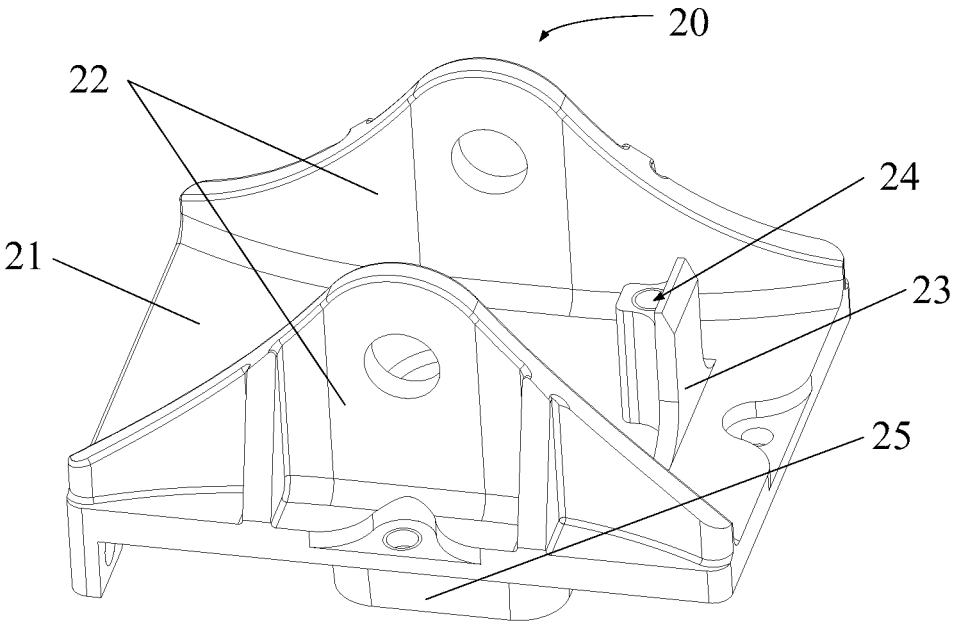
FIG. 4 is a schematic view of a base seat shown in FIG. 3.

Specifically, as shown in FIG. 4, the base seat 20 includes a base plate 21 and two lateral plates 22, the base plate 21 and the two lateral plates 22 define a mounting groove, and the base plate 21 is fixedly connected to the electric motor shaft 11. The adapter 30 is rotatably connected to the two lateral plates 22, and the downrod 40 is connected to the adapter 30.

In this embodiment, in a process of producing and assembling a product, an external force is exerted on the downrod 40, and the downrod 40 drives the adapter 30 to rotate with respect to the base seat 20 to a horizontal state. After the downrod 40 is rotated with respect to the electric motor 10, the volume of the ceiling fan is reduced, such that more ceiling fans can be transported without changing the space for transportation in the transport device, thereby improving the transport efficiency, and moreover, the manual handling may be convenient, thereby improving the handling efficiency. In addition, the base seat 20 and the adapter 30 have simple structures, are easy to assemble and have reliable connections, thereby improving assembly efficiency of the product on the one hand, and enhancing operational reliability of the product on the other hand.

Figure 5:
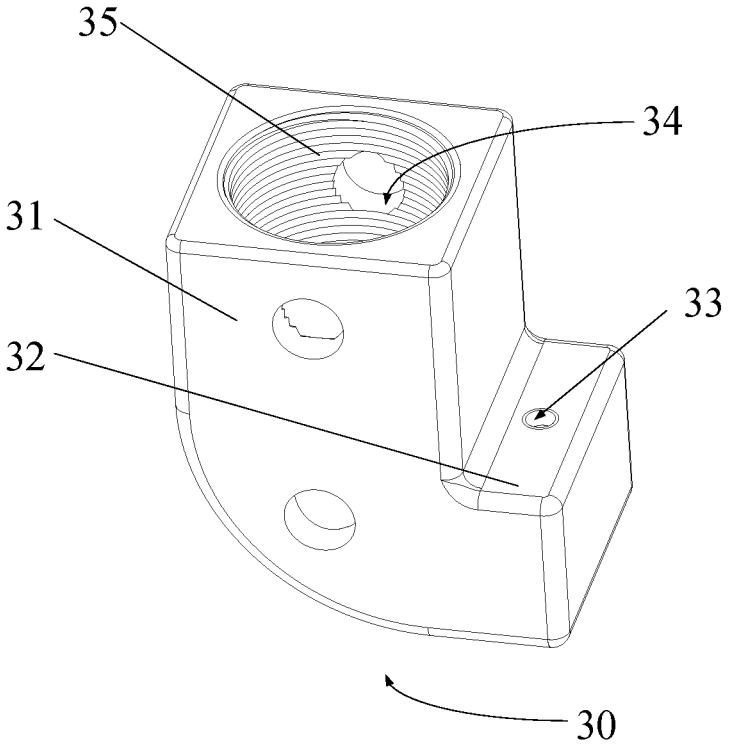
FIG. 5 is a schematic view of an adapter shown in FIG. 3 from a first angle of view.
Figure 6:
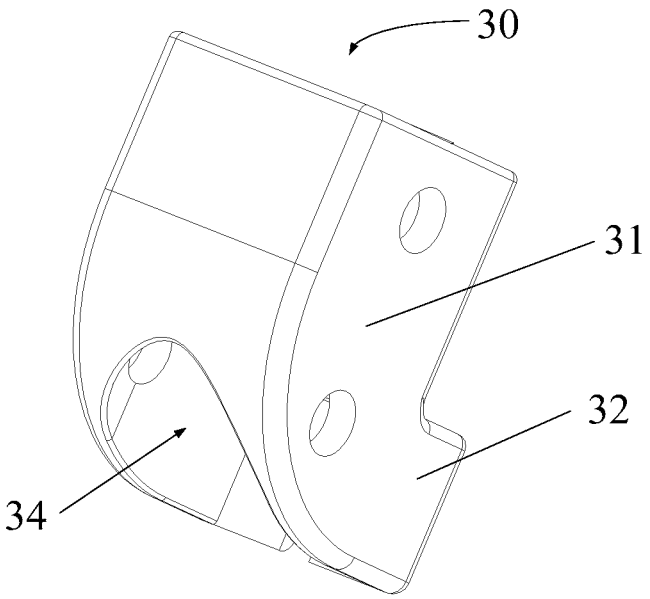
FIG. 6 is a schematic view of the adapter shown in FIG. 3 from a second angle of view.

In a specific embodiment of the present disclosure, as shown in FIGS. 1 to 7, the base seat 20 is provided with a connecting column 23. As shown in FIGS. 5 and 6, the adapter 30 is provided with a connecting hole 33, and a first fixing member passes through the connecting hole 33 to be connected to the connecting column 23, such that the adapter 30 is fixedly connected to the base seat 20.

In this embodiment, when a user needs to mount the ceiling fan, the downrod 40 is rotated with respect to the base seat 20 by means of the adapter 30 until the downrod 40 is perpendicular to a horizontal plane, that is, after the downrod 40 is rotated with respect to the electric motor 10 to be perpendicular to the horizontal plane, the adapter 30 is fixedly connected to the base seat 20 by means of the first fixing member, i.e., the downrod 40 is fixed to the electric motor 10. Thus, it is possible to prevent the electric motor 10 from shaking relative to the downrod 40 during use of the ceiling fan, which otherwise will cause safety problems (e.g. cause the electric motor 10 to fall off), thus enhancing the operational reliability of the product, thereby increasing market competitiveness of the product.

In another embodiment of the present disclosure, the base seat 20 is provided with a first snapping portion, the adapter 30 is provided with a second snapping portion, and the first snapping portion is engaged with the second snapping portion to make the adapter 30 fixedly connected to the base seat 20. When the ceiling fan needs to be mounted, the downrod 40 is rotated; when the downrod 40 is rotated to an appropriate position, the first snapping portion contacts and is engaged with the second snapping portion. Specifically, the first snapping portion is configured as a snapping groove, the second snapping portion is configured as a snap, and the snap is snapped into the snapping groove to make the adapter 30 fixedly connected to the base seat 20.

In an embodiment of the present disclosure, the first fixing member is configured as a first screw (not shown in drawings), the connecting column 23 is provided with a threaded hole 24, and the first screw passes through the connecting hole 33 and is screwed into the threaded hole 24.

In this embodiment, the connection by means of the screw has a simple structure and is reliable, which improves the assembly efficiency of the product and lowers production and manufacturing costs of the product on the one hand, and enhances the operational reliability of the product on the other hand, thereby increasing the market competitiveness of the product.

Figure 8:
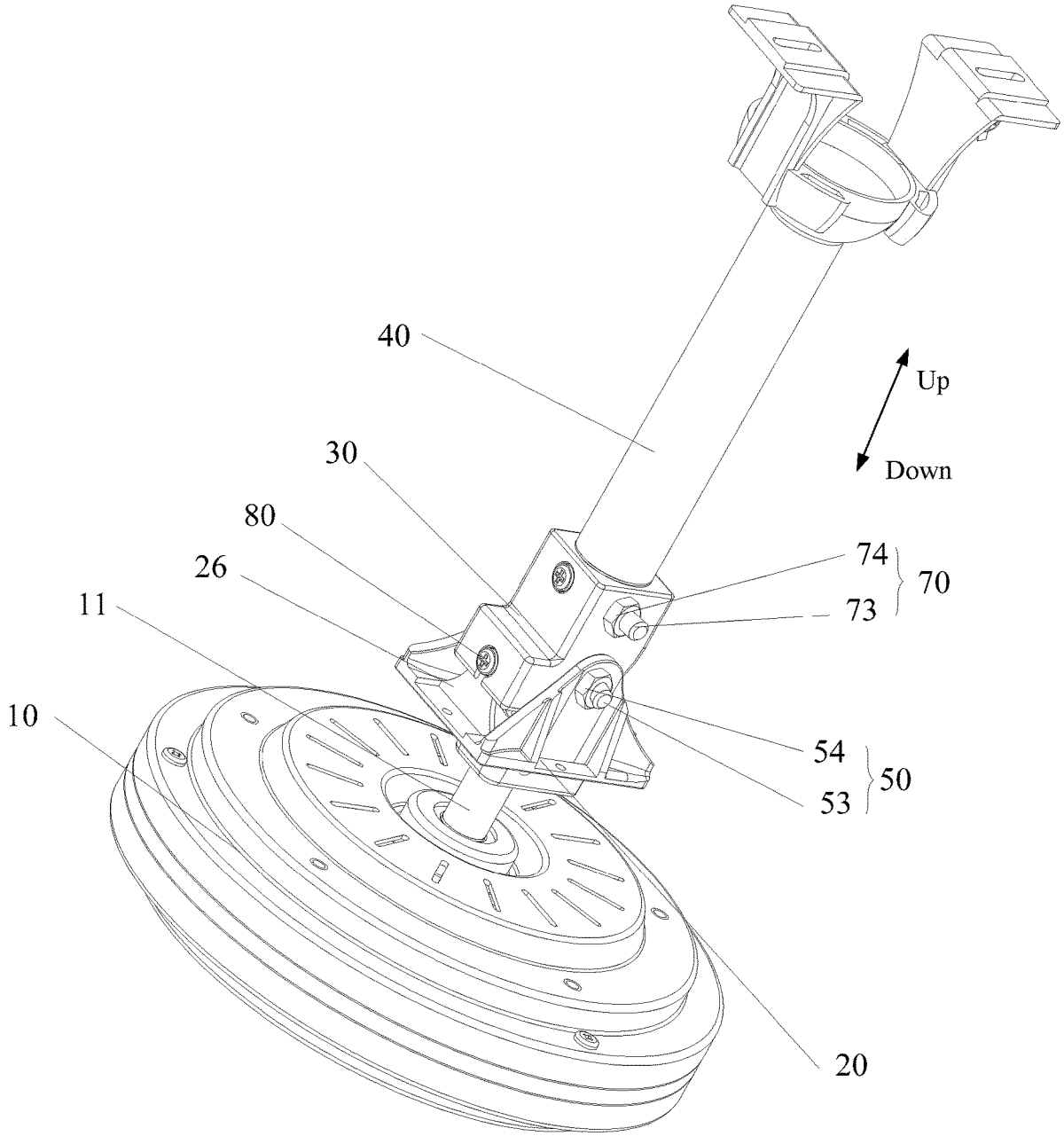
FIG. 8 is a schematic view of a ceiling fan in a first state of a second embodiment according to the present disclosure.
Figure 9:
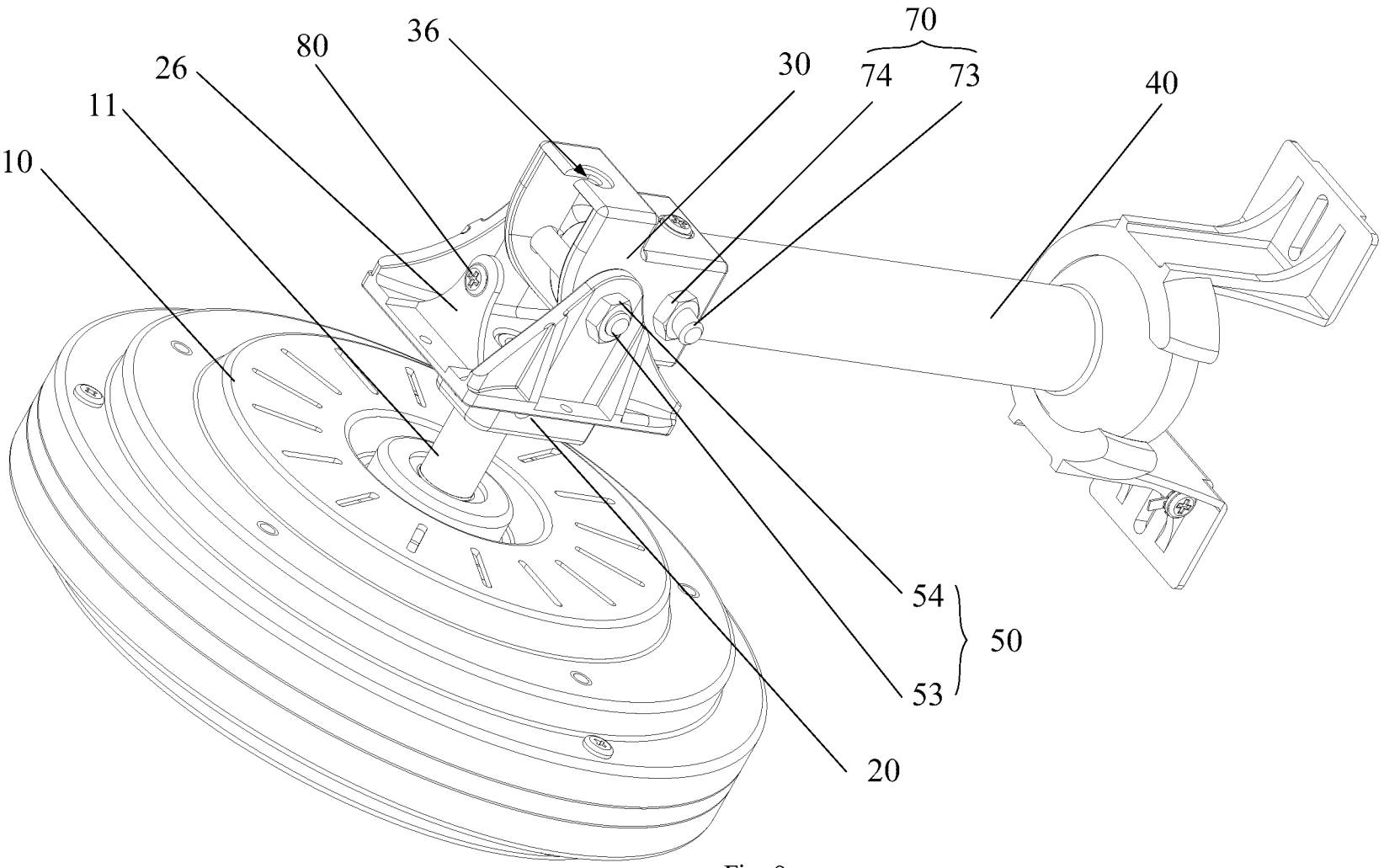
FIG. 9 is a schematic view of the ceiling fan in a second state of a second embodiment according to the present disclosure.

In another specific embodiment of the present disclosure, as shown in FIGS. 8 and 9, the base seat 20 is provided with a positioning plate 26, the positioning plate 26 is provided with a fastening screw 80, and a gap is defined between a head portion of the fastening screw 80 and the positioning plate 26. The adapter 30 is provided with a notch 36. The adapter 30 is rotated to be engaged with the fastening screw 80 through the notch 36, and then the fastening screw 80 is tightened to make the adapter 30 fixedly connected to the base seat 20.

In this embodiment, when the user needs to mount the ceiling fan, the downrod 40 is rotated with respect to the base seat 20 by means of the adapter 30 until the downrod 40 is perpendicular to the horizontal plane, that is, after the downrod 40 is rotated with respect to the adapter 10 to be perpendicular to the horizontal plane, the adapter 30 is engaged with the fastening screw 80 through the notch 36, and then the fastening screw 80 is tightened, such that the adapter 30 is fixed to the base seat 20. i.e., the downrod 40 is fixed to the adapter 10. Thus, it is possible to prevent the adapter 10 from shaking relative to the downrod 40 during use of the ceiling fan, which otherwise will cause safety problems (e.g. cause the adapter 10 to fall off), thus enhancing the operational reliability of the product, thereby increasing the market competitiveness of the product. Since the gap exists between the head portion of the fastening screw 80 and the positioning plate 26, it is ensured that after the adapter 30 is engaged with the fastening screw 80 through the notch 36, the fastening screw 80 may be rotated to connect the positioning plate 26 with the adapter 30.

In addition, the first fixing member may be configured as other parts capable of connecting the base seat 20 with the adapter 30, as long as the parts can achieve the connection between the connecting column 23 and the adapter 30, and thus all of them fall into the protection scope of the present disclosure.

In an embodiment of the present disclosure, as shown in FIGS. 5 and 6, the adapter 30 includes a first connecting portion 31 and a second connecting portion 32 connected sequentially, the adapter 30 has an L shape as a whole, and the first connecting portion 31 and the second connecting portion 32 are connected by a circular arc transition.

In this embodiment, the arrangement of the circular arc transition enables the adapter 30 to rotate more smoothly relative to the base seat 20, thus improving operational comfort of the product, thereby increasing the market competitiveness of the product.

In an embodiment of the present disclosure, as shown in FIG. 6, the second connecting portion 32 is configured as a casing with an open end, the connecting column 23 is inserted into the casing, and the connecting hole 33 is disposed in the casing.

In this embodiment, the connecting column 23 is inserted into the casing to increase a connection area between the connecting column 23 and the casing. When the ceiling fan needs to be mounted, the adapter 30 is fixed to the base seat 20 by means of the first fixing member, i.e., the downrod 40 is fixed to the electric motor 10. Thus, it is possible to prevent the electric motor 10 from shaking relative to the downrod 40 during use of the ceiling fan, which otherwise will cause safety problems (e.g. cause the electric motor 10 to fall off), thus enhancing the operational reliability of the product, thereby increasing the market competitiveness of the product.

In a specific embodiment of the present disclosure, as shown in FIGS. 1 to 6, the base seat 20 is provided with a through hole, and a wall of the through hole extends downwards to form an annular connecting plate 25. The electric motor shaft 11 passes through the through hole, and is connected to the two lateral plates 22 by means of a first connecting member 50. The connecting plate 25 is connected to the electric motor shaft 11 by means of a second fixing member.

In this embodiment, the electric motor shaft 11 is connected to the base seat 20 by means of the first connecting member 50 and the second fixing member, such that it is possible to increase connection strength between the electric motor shaft 11 and the base seat 20, and prevent the electric motor 10 from shaking relative to the base seat 20 during use of the ceiling fan, which otherwise will cause safety problems (e.g. cause the electric motor 10 to fall off), thus enhancing the operational reliability of the product, thereby increasing the market competitiveness of the product.

Figure 2:
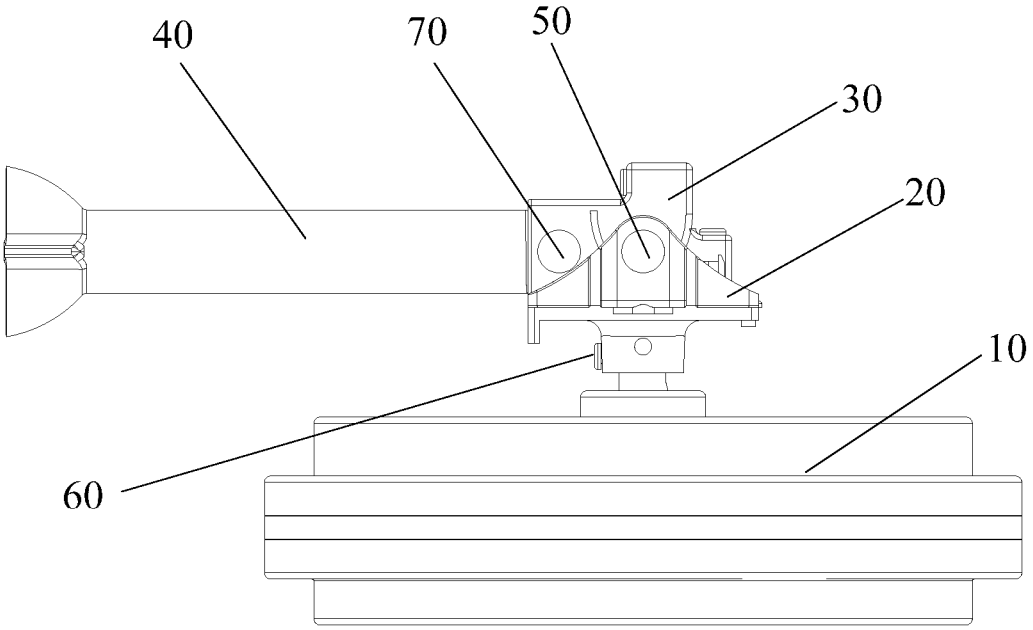
FIG. 2 is a schematic view of a ceiling fan in a second state of a first embodiment according to the present disclosure.
Figure 3:
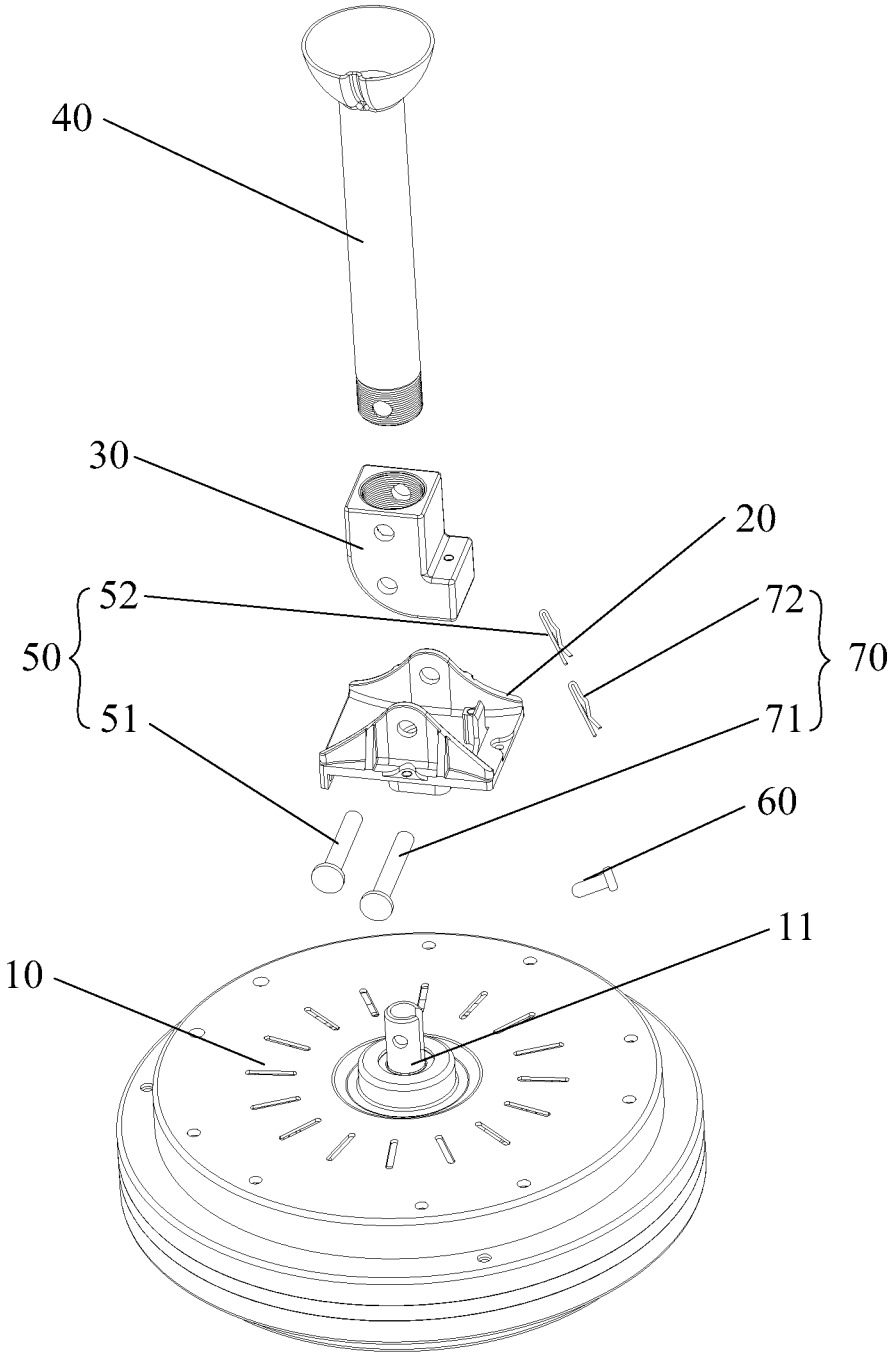
FIG. 3 is an exploded view of the ceiling fan shown in FIG. 1.

In an embodiment of the present disclosure, as shown in FIGS. 1 to 3, the first connecting member 50 includes a first plug pin 51 and a first split pin 52. A first end of the first plug pin 51 passes through a first lateral plate 22, a first end of the adapter 30, the electric motor shaft 11, a second end of the adapter 30, and a second lateral plate 22 sequentially, and extends out of the second lateral plate 22. The first split pin 52 is connected to the first end of the first plug pin 51 and is able to interfere with the second lateral plate 22.

In this embodiment, the connection by means of the plug pin and the split pin has a simple structure and is reliable, which improves the assembly efficiency of the product and lowers production and manufacturing costs of the product on the one hand, and enhances the operational reliability of the product on the other hand, thereby increasing the market competitiveness of the product.

In an embodiment of the present disclosure, as shown in FIGS. 8 and 9, the first connecting member 50 includes a first bolt 53 and a first nut 54. A first end of the first bolt 53 passes through the first lateral plate 22, the first end of the adapter 30, the electric motor shaft 11, the second end of the adapter 30, and the second lateral plate 22 sequentially, and extends out of the second lateral plate 22. The first nut 54 is screwed with the first bolt 53 tightly, such that the base seat 20 is fixedly connected to the electric motor shaft 10.

In this embodiment, the connection through cooperation between the bolt and the nut has a simple structure and is reliable, which improves the assembly efficiency of the product and lowers production and manufacturing costs of the product on the one hand, and enhances the operational reliability of the product on the other hand, thereby increasing the market competitiveness of the product.

In addition, the first connecting member 50 may be configured as other parts capable of connecting the base seat 20 with the electric motor 10, as long as the parts can achieve the connection between the connecting column 23 and the adapter 30, and thus all of them fall into the protection scope of the present disclosure.

In an embodiment of the present disclosure, as shown in FIGS. 1 to 3, the second fixing member is configured as a second screw 60. The second screw 60 penetrates from a first end of the connecting plate 25 and passes through the electric motor shaft 11 to be screwed into a second end of the connecting plate 25.

In this embodiment, the connection by means of the second screw 60 has a simple structure and is reliable, which improves the assembly efficiency of the product and lowers production and manufacturing costs of the product on the one hand, and enhances the operational reliability of the product on the other hand, thereby increasing the market competitiveness of the product.

In addition, the second fixing member may be configured as other parts capable of connecting the electric motor shaft 11 with the adapter 30, as long as the parts can achieve the connection between the connecting column 23 and the adapter 30, and thus all of them fall into the protection scope of the present disclosure.

Figure 7:
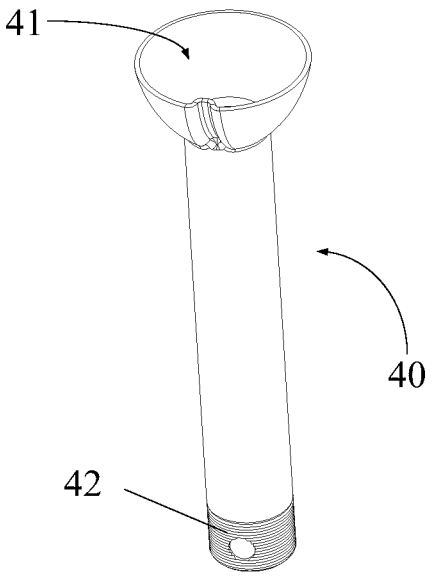
FIG. 7 is a schematic view of a downrod shown in FIG. 3.

In an embodiment of the present disclosure, as shown in FIG. 7, the downrod 40 is provided with a first wire-routing hole 41; as shown in FIG. 6, the adapter 30 is provided with a second wire-routing hole 34; the first wire-routing hole and the second wire-routing hole define a wire-routing passage, and a wire passes through the wire-routing passage to be connected to the electric motor 10.

In this embodiment, the arrangement of the wire-routing holes enables the downrod 40 and the adapter 30 to protect the wire on the one hand, thereby prolonging a service life of the wire, and can hide the wire to make the overall appearance of the ceiling fan more aesthetic on the other hand.

In addition, since the first connecting portion 31 and the second connecting portion 32 are connected by the circular arc transition, it is possible to avoid an impact of a shear force on the wire when the downrod 40 is rotated with respect to the base seat 20, which serves to protect the wire, thereby prolonging the service life of the wire.

In an embodiment of the present disclosure, one of the adapter 30 and the downrod 40 is provided with an internal thread 35, the other one thereof is provided with an external thread 42, and the external thread 42 is screwed into the internal thread 35 to achieve fixed connection between the adapter 30 and the downrod 40. As shown in FIGS. 3, 5 and 7, specifically the adapter 30 is provided with the internal thread 35, and the downrod 40 is provided with the thread.

In this embodiment, the threaded connection has a simple structure and is reliable, which improves the assembly efficiency of the product and lowers production and manufacturing costs of the product on the one hand, and enhances the operational reliability of the product on the other hand, thereby increasing the market competitiveness of the product.

In an embodiment of the present disclosure, the adapter 30 is connected to the downrod 40 by means of a second connecting member 70.

In this embodiment, the adapter 30 is connected to the downrod 40 by means of threads and the second connecting member 70, such that it is possible to increase connection strength between the adapter 30 and the downrod 40, and prevent the base seat 20 from shaking relative to the downrod 40 during use of the ceiling fan, which otherwise will cause safety problems (e.g. cause the electric motor 10 to fall off), thus enhancing the operational reliability of the product, thereby increasing the market competitiveness of the product.

In a specific embodiment of the present disclosure, as shown in FIGS. 1 to 3, the second connecting member 70 includes a second plug pin 71 and a second split pin 72. A first end of the second plug pin 71 penetrates from the first end of the adapter 30, passes through the downrod 40, and extends out of the second end of the adapter 30. The second split pin 72 is connected to the first end of the second plug pin 71 and is able to interfere with the adapter 30.

In this embodiment, the connection by means of the plug pin and the split pin has a simple structure and is reliable, which improves the assembly efficiency of the product and lowers production and manufacturing costs of the product on the one hand, and enhances the operational reliability of the product on the other hand, thereby increasing the market competitiveness of the product.

In another specific embodiment of the present disclosure, as shown in FIGS. 8 and 9, the second connecting member 70 includes a second bolt 73 and a second nut 74. A first end of the second bolt 73 penetrates from the first end of the adapter 30, passes through the downrod 40, and extends out of the second end of the adapter 30. The second nut 74 is screwed with the second bolt 73 tightly, such that the downrod 40 is fixedly connected to the adapter 30.

In this embodiment, the connection through cooperation between the bolt and the nut has a simple structure and is reliable, which improves the assembly efficiency of the product and lowers production and manufacturing costs of the product on the one hand, and enhances the operational reliability of the product on the other hand, thereby increasing the market competitiveness of the product.

In addition, the second connecting member 70 may be configured as other parts capable of connecting the downrod 40 with the adapter 30, as long as the parts can achieve the connection between the connecting column 23 and the adapter 30, and thus all of them fall into the protection scope of the present disclosure.

As shown in FIGS. 1 to 3, FIG. 8 and FIG. 9, the ceiling fan provided by embodiments of a second aspect of the present disclosure includes the electric motor 10 and the downrod assembly according to any one of the above embodiments. The downrod assembly is connected to the electric motor shaft 11 of the electric motor 10.

The ceiling fan provided by embodiments of the second aspect of the present disclosure has all of the above beneficial effects since it is provided with the downrod assembly according to embodiments of the first aspect of the present disclosure, which will not be elaborated herein.

In conclusion, for the ceiling fan provided by the present disclosure, the downrod is able to rotate with respect to the electric motor, and the downrod is folded during transportation and handling to reduce the volume of the ceiling fan, thereby reducing the packaging volume. On the one hand, more ceiling fans can be transported without changing the space for transportation in the transport device, thereby improving the transport efficiency, and moreover, the manual handling may be convenient, thereby improving the handling efficiency.

Specifically, the ceiling fan in the related art is packaged and transported either after being assembled, or after being detached. However, the assembled ceiling fan has a relatively large volume, which is not convenient for packaging and transportation; some of the individual parts of the ceiling fan have are easily lost during handling and transportation due to a small volume. For the ceiling fan provided by the present disclosure, the downrod is able to rotate with respect to the electric motor, and the downrod is folded during transportation and handling to reduce the volume of the ceiling fan. On the one hand, it is possible to avoid loss of small parts caused by detaching and packaging individual parts of the ceiling fan. On the other hand, it is possible to avoid the inconvenient handling and the low transport efficiency of the ceiling fan caused by a large volume of the downrod and the electric motor in the assembled ceiling fan. Specifically, the volume of the ceiling fan is relatively small after the downrod rotates with respect to the electric motor, such that more ceiling fans can be transported without changing the space for transportation in a transport device, thereby improving the transport efficiency, and moreover, the manual handling may be convenient, thereby improving handling efficiency.

In the present disclosure, terms such as "first" and "second" are used herein only for purposes of description and are not intended to indicate or imply relative importance or significance. Terms "mounted," "connected," "coupled" and "fixed" are interpreted broadly and may be, for example, fixed connections, detachable connections, or integral connections; may also be direct connections or indirect connections via intervening structures, which can be understood by those skilled in the art according to specific situations.

In the description of the present disclosure, it should be understood that terms "on" or "below" should be construed to refer to the orientation as then described or as shown in the drawings under discussion. These relative terms are for convenience of description and do not indicate or imply that the device or element referred to must have a particular orientation, or be constructed or operated in a particular orientation. Thus, the terms cannot be constructed to limit the present disclosure.

Reference throughout this specification to "an embodiment," "some embodiments" or "a specific embodiment," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although only preferred embodiments of the present disclosure have been illustrated, it shall be understood that the preferred embodiments are not constructed to limit the present disclosure, and various modifications and changes are acceptable for those skilled in the art. Any modifications, equivalents, alternatives, and improvements without departing from spirit and principles of the present disclosure can fall into the protection scope of the present disclosure.

What is claimed is:

1. A downrod assembly used for connecting to an electric motor of a ceiling fan, and comprising:

an adapter subassembly connected to an electric motor shaft of the electric motor, wherein the adapter subassembly comprises a base seat comprising a base plate and two lateral plates, and an adapter rotatably connected to the two lateral plates and connected to a downrod, wherein the base seat is provided with a connecting column, the adapter is provided with a connecting hole, and a first fixing member is configured to pass through the connecting hole to be connected to the connecting column, such that the adapter is fixedly connected to the base seat; and the downrod connected to the adapter subassembly and capable of rotating with respect to the electric motor by means of the adapter subassembly.

2. The downrod assembly according to claim 1, a wherein the base plate and the two lateral plates define a mounting groove, and the base plate is configured to be fixedly connected to the electric motor shaft.

3. The downrod assembly according to claim 1, wherein the first fixing member is a first screw, the connecting column is provided with a threaded hole, and the first screw is configured to pass through the connecting hole and is screwed into the threaded hole.

4. The downrod assembly according to claim 2, wherein the base seat is provided with a positioning plate, the positioning plate is provided with a fastening screw, and the adapter is provided with a notch, wherein the adapter is configured to be rotated to be engaged with the fastening screw through the notch, and then the fastening screw is tightened, such that the adapter is fixedly connected to the base seat.

5. The downrod assembly according to claim 2, wherein the base seat is provided with a through hole, and a wall of the through hole extends downwards to form an annular connecting plate; the electric motor shaft is configured to pass through the through hole and be connected to the two lateral plates by means of a first connecting member; and the annular connecting plate is connected to the electric motor shaft by means of a second fixing member.

6. The downrod assembly according to claim 5, wherein the first connecting member comprises a first plug pin and a first split pin; a first end of the first plug pin is configured to pass through a first lateral plate, a first end of the adapter, the electric motor shaft, a second end of the adapter, and a second lateral plate sequentially, and extend out of the second lateral plate; the first split pin is configured to be connected to the first end of the first plug pin and interfere with the second lateral plate.

7. The downrod assembly according to claim 5, wherein the first connecting member comprises a first bolt and a first nut; a first end of the first bolt is configured to pass through a first lateral plate, a first end of the adapter, the electric motor shaft, a second end of the adapter, and a second lateral plate sequentially, and extend out of the second lateral plate; the first nut is configured to be screwed with the first bolt, such that the base seat is fixedly connected to the electric motor shaft.

8. The downrod assembly according to claim 5, wherein the second fixing member is a second screw; the second screw is configured to penetrate a first end of the annular connecting plate and pass through the electric motor shaft to be screwed into a second end of the annular connecting plate.

9. The downrod assembly according to claim 2, wherein the downrod is provided with a first wire-routing hole, the adapter is provided with a second wire-routing hole, the first wire-routing hole and the second wire-routing hole define a wire-routing passage, enabling a wire to pass through the wire-routing passage to be connected to the electric motor.

10. The downrod assembly according to claim 2, wherein one of the adapter and the downrod is provided with an internal thread, the other one thereof is provided with an external thread, and the external thread is screwed into the internal thread, such that the adapter is fixedly connected to the downrod.

11. The downrod assembly according to claim 10, wherein the adapter is connected to the downrod by means of a second connecting member.

12. The downrod assembly according to claim 11, wherein the second connecting member comprises a second plug pin and a second split pin; a first end of the second plug pin is configured to penetrate a first end of the adapter, pass through the downrod, and extend out of a second end of the adapter; the second split pin is configured to be connected to the first end of the second plug pin to interfere with the adapter.

13. The downrod assembly according to claim 11, wherein the second connecting member comprises a second bolt and a second nut; a first end of the second bolt is configured to penetrate a first end of the adapter, pass through the downrod, and extend out of a second end of the adapter; the second nut is screwed with the second bolt, such that the downrod is fixedly connected to the adapter.

14. A downrod assembly used for connecting to an electric motor of a ceiling fan comprising:

an adapter subassembly connected to an electric motor shaft of the electric motor, the adapter subassembly comprises:

a base seat comprising a base plate and two lateral plates, wherein the base plate and the two lateral plates define a mounting groove, and the base plate is configured to be fixedly connected to the electric motor shaft; and an adapter rotatably connected to the two lateral plates and connected to the downrod; and a downrod connected to the adapter subassembly and capable of rotating with respect to the electric motor by means of the adapter subassembly, wherein the base seat is provided with a connecting column, the adapter is provided with a connecting hole, and a first fixing member is configured to pass through the connecting hole to be connected to the connecting column, such that the adapter is fixedly connected to the base seat, and wherein the adapter comprises a first connecting portion and a second connecting portion connected to the first connecting portion by a circular arc transition, the adapter has an L shape as a whole.

15. The downrod assembly according to claim 14, wherein the second connecting portion includes a casing with an open end, the connecting column is inserted into the casing, and the connecting hole is disposed in the casing.

16. A ceiling fan comprising:

an electric motor; and a downrod assembly connected to an electric motor shaft of the electric motor, wherein the downrod assembly further comprises:

an adapter subassembly connected to the electric motor shaft of the electric motor, wherein the adapter subassembly comprises a base seat comprising a base plate and two lateral plates, and an adapter rotatably connected to the two lateral plates and connected to a downrod, wherein the base seat is provided with a connecting column, the adapter is provided with a connecting hole, and a first fixing member is configured to pass through the connecting hole to be connected to the connecting column, such that the adapter is fixedly connected to the base seat; and the downrod connected to the adapter subassembly and capable of rotating with respect to the electric motor by means of the adapter subassembly.

17. The ceiling fan according to claim 16, wherein the base plate and the two lateral plates define a mounting groove, and the base plate is fixedly connected to the electric motor shaft.

18. The ceiling fan according to claim 17, wherein the base seat is provided with a positioning plate, the positioning plate is provided with a fastening screw, and the adapter is provided with a notch, wherein the adapter is rotated to be engaged with the fastening screw through the notch, and then the fastening screw is tightened, such that the adapter is fixedly connected to the base seat.

* * * * *